US005251454A

United States Patent [19]

Yoon

[11] Patent Number: 5,251,454

[45] Date of Patent: Oct. 12, 1993

[54] DEFROST CONTROL APPARATUS AND METHOD FOR A REFRIGERATING SYSTEM

[75] Inventor: Kwang H. Yoon, Suweon, Rep. of Korea

[73] Assignee: Samsung Electronics Co., Ltd., Suweon, Rep. of Korea

[21] Appl. No.: 827,336

[22] Filed: Jan. 30, 1992

[30] Foreign Application Priority Data

Jan. 31, 1991 [KR] Rep. of Korea ..... 91-1696

[51] Int. Cl.[5] ..... F25D 21/02

[52] U.S. Cl. ..... 62/156; 62/140

[58] Field of Search ..... 62/156, 155, 140, 152, 62/154, 234, 180, 186, 80, 81, 82

[56] References Cited

U.S. PATENT DOCUMENTS

| | | | |
|---|---|---|---|
| 2,104,219 | 1/1938 | Bloom | 62/140 |
| 3,362,183 | 1/1968 | Sutton, Jr. | 62/140 |
| 4,045,971 | 9/1977 | Brenner, Jr. | 62/140 |
| 4,345,441 | 8/1982 | Hansen | 62/156 X |
| 4,843,833 | 7/1989 | Polkinghorne | 62/156 X |
| 4,974,417 | 12/1990 | Levine et al. | 62/156 |

FOREIGN PATENT DOCUMENTS

| | | | |
|---|---|---|---|
| 0000941 | 1/1981 | Japan | 62/156 |
| 56-149568 | 11/1981 | Japan . | |
| 0087550 | 6/1982 | Japan | 62/156 |
| 58-178171 | 10/1983 | Japan . | |
| 0125050 | 7/1984 | Japan | 62/156 |
| 0031668 | 2/1991 | Japan | 62/156 |

*Primary Examiner*—Harry B. Tanner

*Attorney, Agent, or Firm*—Burns, Doane, Swecker & Mathis

[57] ABSTRACT

A thermistor is mounted between the fins of an evaporator. The thermistor senses the temperature about the evaporator when a blow fan mounted at the evaporator is driven and when it halts. The two sensed temperatures are compared, so that when the difference of the two temperatures is below a first set value, a defrost operation starts. When the temperature about the evaporator is above a second set value, the defrost operation is completed.

4 Claims, 4 Drawing Sheets

DEFROST CONTROL APPARATUS AND METHOD FOR A REFRIGERATING SYSTEM

BACKGROUND OF THE INVENTION

The present invention relates to a refrigerating system, and particularly to a defrost control apparatus and method which initiates defrost operation by obtaining the difference between the temperatures in the vicinity of an evaporator when driving and halting a blow fan and comparing the difference in temperatures with a predetermined set value.

In conventional refrigerators, defrost operation is executed irrespective of the quantity of the frost produced at an evaporator whenever the predetermined time elapses. However, the quantity of the frost produced at the evaporator depends on temperature, humidity about an evaporator and the quantity of the foods stored in the refrigerator.

Therefore, the conventional apparatus have the following problems:

Even though little frost is produced because of low temperature, low humidity about an evaporator and the little quantity of foods stored in the refrigerator, defrost operation is executed at the predetermined interval, so that power is wasted due to the unnecessary operation of a defrost heater.

On the other hand, although much frost is produced because of the high temperature and the high humidity about the evaporator and the large quantity of foods stored in the refrigerator, defrost operation is not executed till the predetermined time elapses, so that the efficiency of heat exchange and cooling efficiency of the refrigerator are deteriorated, and the internal temperature of the refrigerator rises.

A typical example solving the problem described above is disclosed in Japanese Laid-Open Patent Sho 58-178171. This apparatus includes blow speed detection elements mounted at the inlet and outlet of an evaporator and thermistor attached in the proximity of the evaporator and in the inlet duct. Thus, an output signal of blow speed difference and an output signal of temperature difference are ANDed, and the output signal of the AND logic is the defrost start signal. This invention is different from the present invention in that the defrost start time is determined by detecting temperatures at the proximity of the evaporator and in the inlet duct and blow speeds at the inlet and the outlet of the evaporator.

Another example solving the problem described above is disclosed in Japanese Laid-Open Patent Sho 56-149568. This invention includes a thermistor mounted in the position corresponding to the permissible thickness of frost and a thermistor mounted on the evaporator and compares the two sensed temperatures, so that when the difference is less than the predetermined value, the defrost operation starts. This invention is different from the present invention in that it senses temperatures on the evaporator and in the position corresponding to the permissible thickness of frost irrespective of the driving and halting of the evaporator blow fan.

Still another example solving the problem described above is disclosed in U.S. Pat. No. 4,045,971. This invention includes a heat conducting means attached to an evaporator and an air duct embracing a heat conducting means and being made of opaque materials in which a photo-source and photo-detector are mounted. When the light emitted from the photo-source reflects from the heat conducting means, the photo-detector detects the reflected light. This invention determines whether or not to start the defrost operation depending on the reflected quantity of light. Also, this invention is different from the present invention in that it does not consider the state of the blow fan and detects the quantity of frost produced at the heat conducting means.

SUMMARY OF THE INVENTION

To overcome these and other problems, the present invention provides an improved defrost control apparatus and method for a refrigerating system.

It is an object of the present invention to provide an apparatus and method which determines whether or not the quantity of frost produced at an evaporator is below a quantity.

It is another object of the present invention to provide an apparatus and method which determines the time in which it starts the defrost operation using the variation of temperature which the temperature sensor mounted on the evaporator detects.

To achieve the objects described above, a thermistor is mounted between the fins of an evaporator. The thermistor senses the temperature about the evaporator when a blow fan mounted at the evaporator is driven and when it halts. The two sensed temperatures are compared, so that when the difference of the two temperatures is less than a first set value, the defrost operation starts. When the temperature around the evaporator is greater than a second set value, the defrost operation is completed.

DETAILED DESCRIPTION OF THE PREFERRED EMBODIMENT

Figure 1:
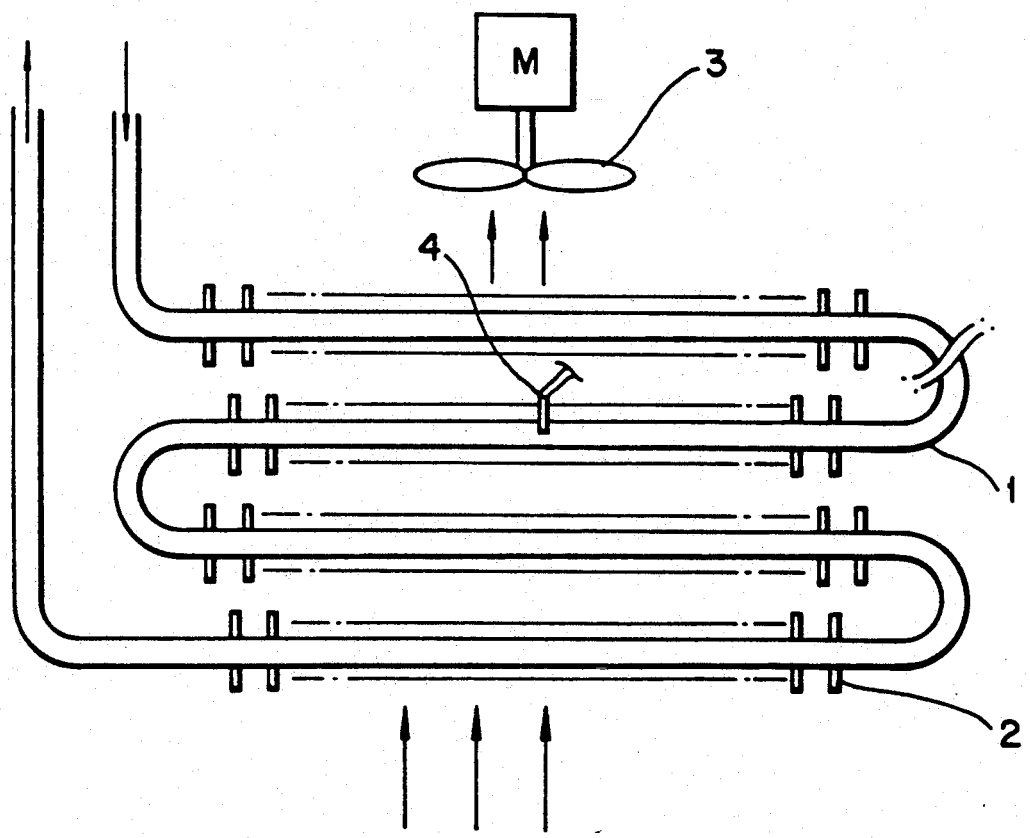
FIG. 1 is a plane view showing an evaporator including a thermistor according to the present invention.

In reference to the drawings, the preferred embodiment of the present invention is described as follows:

In FIG. 1, fins 2, . . . are mounted on evaporator 1 at a constant space. A blow fan 3 is installed behind the evaporator 1 and it blows the air cooled by the evaporator inside the compartments. In the apparatus according to the present invention, a temperature sensor such as a thermistor is mounted between fins 2 of the evaporator 1 described above.

Figure 2B:
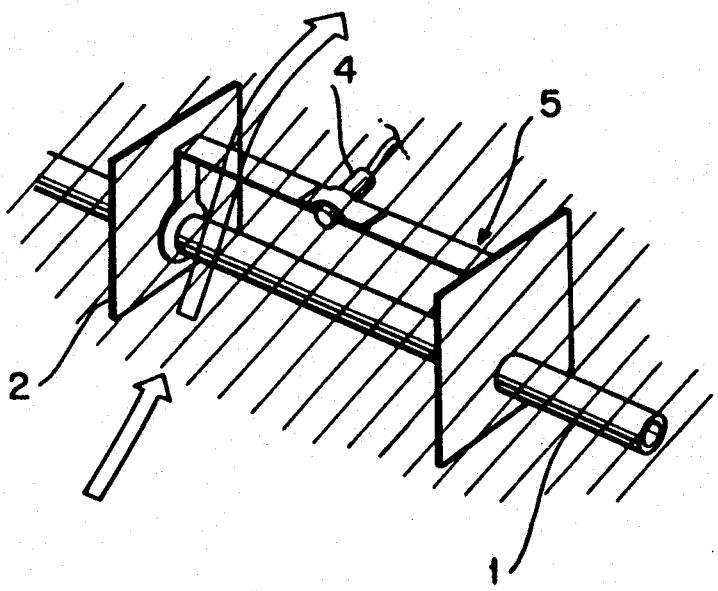
FIG. 2(*a*) and (*b*) are perspective views showing fixing means on which a thermistor is mounted, and (a) shows fins about the thermistor when frost does not form, (b) shows fins about the thermistor when frost forms.
Figure 2A:
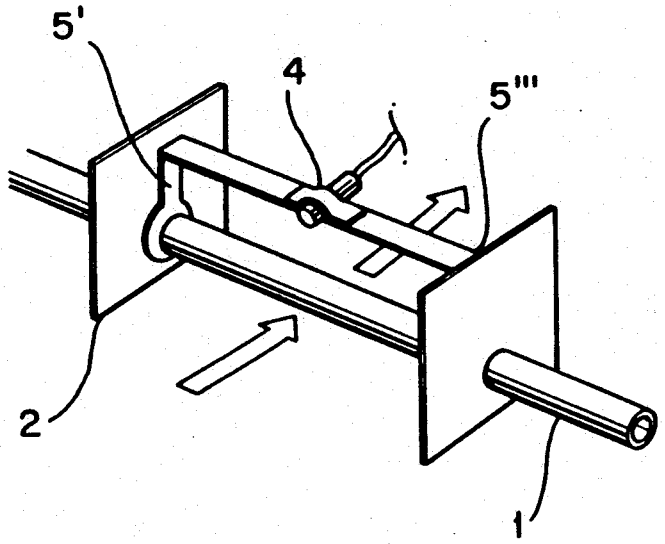

Referring to FIG. 2, fixing device 5 includes arms 5′ and 5″ disposed in a space shorter than the distance between fins 2 and coupled to the evaporator 1 and frame 5‴ linking the arms 5′ and 5″. A temperature sensor 4 is mounted in the middle of the frame 5 and senses temperature about the evaporator 1. Here, a length of the arms 5′ and 5″ is shorter than the thickness of frost which prevents the evaporator 1 from heat-exchanging. Thus, the frost is produced at the evaporator 1, so that it embraces the temperature sensor 4, and because it prevents the evaporator 1 from heat-exchanging, there is no variation of the temperature that the temperature sensor 4 senses.

That is to say, as shown in FIG. 2(*a*), when frost is not produced at the evaporator 1 and the blow fan 3 is driven, the air passes rapidly through the evaporator 1. Accordingly, because the air about the temperature sensor 4 is heat-exchanged by the evaporator 1, the temperature sensor 4 senses the low temperature of the air. During a pause of the blow fan 3, the air passes slowly through the evaporator 1 by convection, so that the quantity of the heat-exchanged air is little. Accordingly, the temperature sensor 4 senses a higher temperature than that which it senses when the blow fan 3.

On the other hand, when much frost is formed at the evaporator 1 and fin 2 as shown in FIG. 2(*b*), there is no variation in the sensed temperature irrespective of the drive state of the blow fan 3. The reason for this phenomenon is described as follows: although the chilled air is passed through by the blow fan 3, it does not contact and circumvents the temperature sensor 4 because of the frost formed at the evaporator 1. Accordingly, the chilled air does not affect the temperature sensor 4. As described above, the present invention determines the quantity of the frost formed at an evaporator by comparing the difference between temperatures sensed during the driving and halting of a blow fan.

Figure 3:
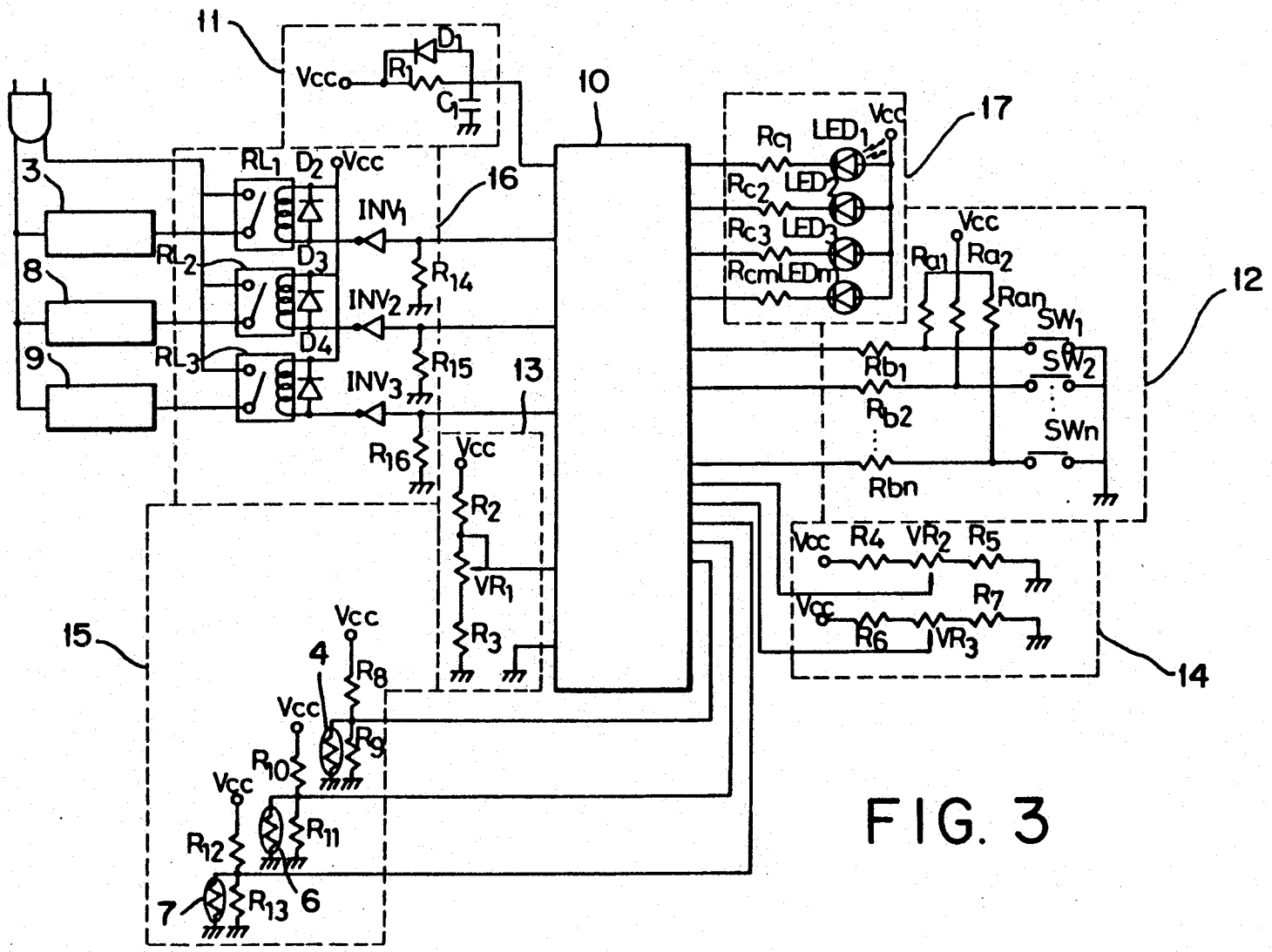
FIG. 3 is a circuit diagram of a refrigerator according to the present invention.

Referring to FIG. 3, the composition of the control circuit applied to the present invention is described as follows:

Microprocessor 10 controls all the operations of a refrigerator in order to perform temperature adjustment and defrost operations. Reset portion 11 supplies a reset signal to the microprocessor 10 when the power is turned on. Function selecting portion 12 includes a multitude of selecting buttons SW1–SWn and inputs operation commands through them. Reference voltage setting portion 13 supplies the reference voltage for analog to digital conversion to the microprocessor 10. Temperature adjusting portion 14 adjusts the temperature of the refrigerator. Temperature sensing portion 15 includes three thermistors 4, 6 and 7 which senses the freezing compartment, refrigerating compartment and evaporator, and the temperatures sensing portion outputs the sensed temperatures to the microprocessor 10. Load control portion 16 controls the blow fan 3, the compressor 8 and the defrost heater 9 according to the control signal from the microprocessor 10. Display portion 17 shows the operations of each portion controlled according to the control signal from the microprocessor 10.

Figure 4:
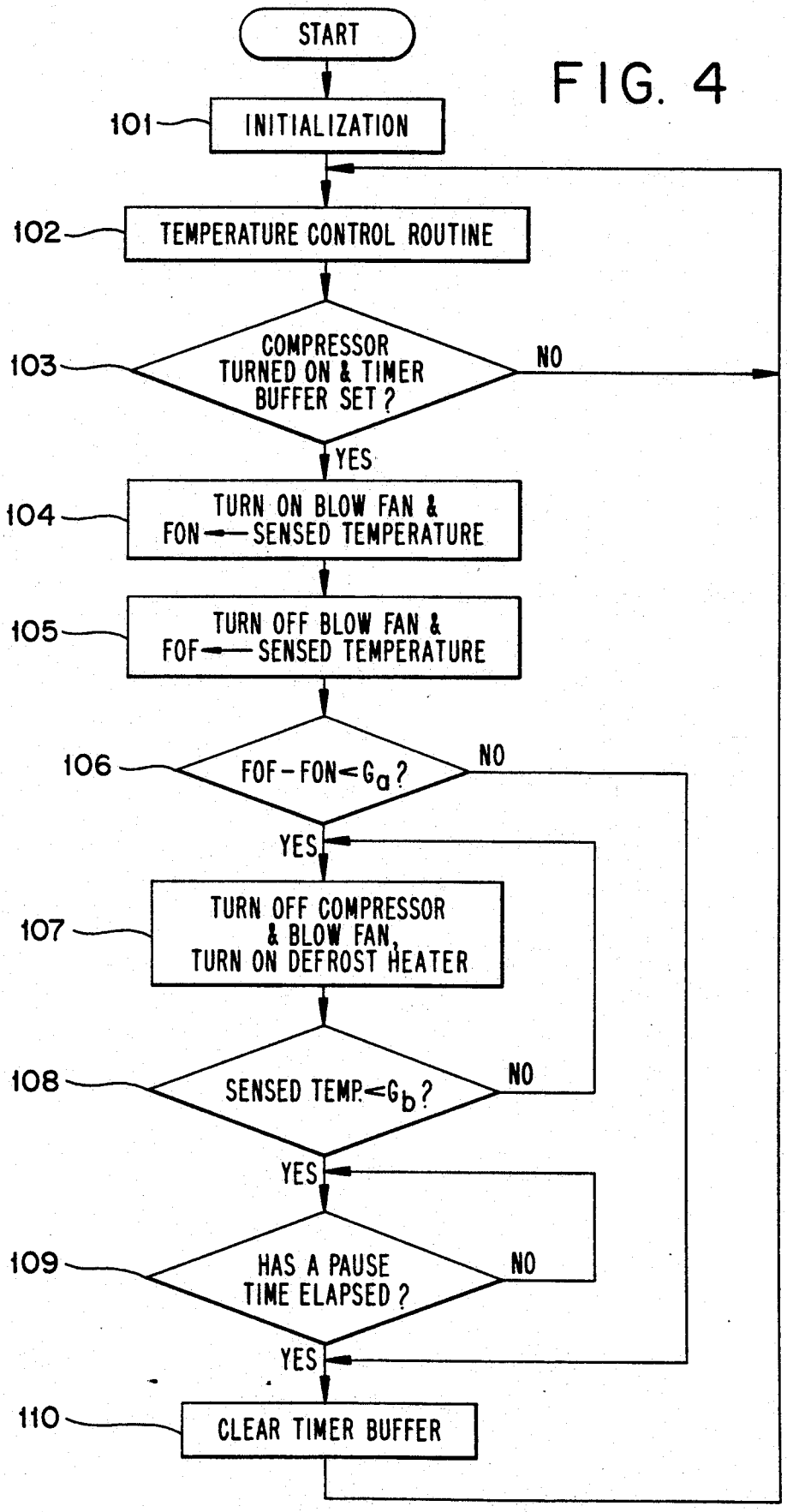
FIG. 4 is a flow chart showing the defrost control method according to the present invention.

Referring to FIG. 4, the defrost control method according to the present invention is described as follows:

In step 101, an initializing operation is performed after the power is turned on. In step 102, the general temperature control routine is performed, so that the compressor 8 and blow fan 3 are turned on and off and dampers are closed and opened according to the control of the microprocessor 10. Accordingly, the temperature in the refrigerator is suitably adjusted. In step 103, in order to periodically check the defrost time, a timer buffer is checked every predetermined time, for example, every hour, and the operation of the compressor 8 is checked. Thus, during driving of the compressor, the temperature control routine is repeatedly executed until the timer buffer is set. As a result of step 103, if the timer buffer is set during driving of the compressor 8, the blow fan 3 is driven and the temperature data sensed by the temperature sensor 4 is stored in the buffer FON in step 104. In step 105, the blow fan 3 is stopped and the temperature data sensed by the temperature sensor 4 is stored in the buffer FOF after the predetermined delay time. At this time, when the blow fan 3 is stopped or driven, it is driven or stopped during the predetermined delay time until the blow fan 3 is driven to the rating r.p.m. or completely stopped, whereby the temperature about the evaporator 1 is sensed when the blow fan 3 is completely driven or stopped in the normal state.

Successively, in step 106, the values of the two buffers FON and FOF are compared to each other and the difference between the two values is obtained, and it is determined whether or not the difference is less than a first set value Ga. Here, the first set value Ga is approximately near 0 as a constant determined by experiments. As the result of step 106, if a difference between the two buffers is greater than the first set value Ga, the defrost operation is not executed and step 110 is executed next, so that after one hour elapses, it is determined whether or not frost is formed.

As the result of step 106, if the difference is less than the first set value because of the frost formed at the temperature sensor 4, in step 107, the compressor 8 and blow fan 3 are turned off and the defrost heater 9 is turned on, so that the defrost operation is initiated. In step 108, it is determined whether or not the temperature sensed by the temperature sensor 4 is above a second set value Gb, and the defrost heater 9 is operated until the sensed value is above the second set value. Here, the second set value Gb is a temperature relating to the completion of the defrost operation, and the temperature is determined by experiments.

If the temperature sensed after starting the defrost operation is greater than the second set value Gb, in step 109, the defrost heater 9 is turned off and it is determined whether or not a predetermined time has elapsed. As a result of step 109, if the predetermined time has elapsed, in step 110, the timer buffer is cleared, so that it is ready to count the defrost time again and then the control process returns to step 102.

As described above, the present invention checks the quantity of frost formed at an evaporator periodically, and only when much frost is formed, the defrost operation is executed. Therefore, it has the advantage in that the temperature in the refrigerator is stable, power is not wasted, and it economizes the production cost because a defrost timer is unnecessary.

What is claimed is:

1. A refrigerating system including an evaporator, a fan for blowing air through the evaporator and a defrost heater, comprising:

a temperature sensing means disposed near the evaporator:

a microprocessor for obtaining a difference between a temperature sensed by the temperature sensing means when the fan is driven and a temperature sensed by the temperature sensing means when the fan is paused, said microprocessor controlling the fan, initiating a defrost operation by driving the defrost heater when the difference in temperature is less than a first set value, and completing the defrost operation by turning off the defrost heater when the temperature sensed by the temperature sensing means is greater than a second set value.

2. A refrigerating system as claimed in claim 1, which further includes fixing means comprised of two arms coupled to the evaporator at a spaced apart distance, and a frame connecting the two arms and having the temperature sensing means mounted thereon.

3. A refrigerating system as claimed in claim 2, wherein the length of the arms are shorter than the thickness of the permissible frost.

4. A defrost control method for a refrigerating system which periodically detects a temperature about an evaporator by a temperature sensing means mounted in a predetermined space near the evaporator and determines a defrost start time from the sensed temperatures, comprising the steps of:

sensing at least two temperatures with the temperature sensing means, a first temperature being sensed during the driving of the fan and a second temperature being sensed during a pause of the fan;

completing the defrost operation by turning off the defrost heater when the temperature sensed by the temperature sensing means is greater than a second set valve.

* * * * *